US011478670B2

(12) United States Patent
Czarnek

(10) Patent No.: US 11,478,670 B2
(45) Date of Patent: Oct. 25, 2022

(54) WATER-MIST FIRE EXTINGUISHING SYSTEM

(71) Applicant: Robert Czarnek, Johnstown, PA (US)

(72) Inventor: Robert Czarnek, Johnstown, PA (US)

( * ) Notice: Subject to any disclaimer, the term of this patent is extended or adjusted under 35 U.S.C. 154(b) by 292 days.

(21) Appl. No.: 16/613,941

(22) PCT Filed: May 15, 2018

(86) PCT No.: PCT/US2018/032626
§ 371 (c)(1),
(2) Date: Nov. 15, 2019

(87) PCT Pub. No.: WO2018/213214
PCT Pub. Date: Nov. 22, 2018

(65) Prior Publication Data

US 2021/0322809 A1 Oct. 21, 2021

Related U.S. Application Data

(60) Provisional application No. 62/506,704, filed on May 16, 2017.

(51) Int. Cl.
*A62C 5/00* (2006.01)
*A62C 13/64* (2006.01)
*A62C 13/76* (2006.01)

(52) U.S. Cl.
CPC ..... *A62C 5/008* (2013.01); *A62C 13/64* (2013.01); *A62C 13/76* (2013.01)

(58) Field of Classification Search
CPC ..... A62C 5/008; A62C 13/64; A62C 13/76; A62C 35/023; A62C 99/0072; A62C 13/62
See application file for complete search history.

(56) References Cited

U.S. PATENT DOCUMENTS 2,778,434 A * 1/1957 Hastert ..... A62C 13/64 222/5
4,505,336 A * 3/1985 Thevis ..... A62C 13/68 239/526

(Continued)

FOREIGN PATENT DOCUMENTS

EP 2018895 A1 1/2009

OTHER PUBLICATIONS

International Search Report for International Application No. PCT/US2018/032626 dated Aug. 31, 2018.

*Primary Examiner* — Joseph A Greenlund
(74) *Attorney, Agent, or Firm* — The Webb Law Firm

(57) ABSTRACT

A fire extinguisher includes a liquid fire extinguishing media, and first and second gases inside of a storage vessel at an operating pressure, and a discharge tube extending between a control valve and the fire extinguishing media. At least a portion of the first gas is dissolved in the fire extinguishing media. The control valve can be operated to control discharge of the fire extinguishing media via the discharge tube whereupon at least a portion of the second gas enters a flow of the fire extinguishing media via one or more holes in the discharge tube forming bubbles of the second gas in the flow of the fire extinguishing media. The fire extinguishing media exiting the control valve can pass through a nozzle which can causing first and second portions of the fire extinguishing media to collide forming a plume mist of the fire extinguishing media.

19 Claims, 6 Drawing Sheets

| | Water | Foam | Carbon Dioxide | Dry Chemical | Wet Chemical | Clean Agent | Dry Powder | Water Mist |
|---|---|---|---|---|---|---|---|---|
| Class A | ✓ | ✓ | ✗ | ✓ | Sometimes | Larger Models | ✗ | ✓ |
| Class B | ✗ | ✓ | ✓ | ✓ | ✗ | ✓ | ✗ | ✗ |
| Class C | ✗ | ✗ | ✓ | ✓ | ✗ | ✓ | ✗ | ✓ |
| Class D | ✗ | ✗ | ✗ | ✗ | ✗ | ✗ | ✓ | ✗ |
| Class K | ✗ | ✗ | ✗ | ✗ | ✓ | ✗ | ✗ | ✗ |
| Methods Used to Extinguish Flame | Removes the heat element | Separates the oxygen from the other elements | Takes away the oxygen and heat with cold discharge | interrupts the chemical reaction (B,C) Creates a barrier between oxygen and fuel(A) | Removes heat and creates a barrier between oxygen and fuel | Interrupts the chemical reaction | Removes heat and creates a barrier between oxygen and fuel | Removes the heat element |

(56) References Cited

U.S. PATENT DOCUMENTS 5,996,699 A * 12/1999 Sundholm ..... A62C 35/023 239/372
6,112,822 A * 9/2000 Robin ..... A62C 35/023 169/46
6,173,790 B1 * 1/2001 Russwurm ..... A62C 99/0072 169/44
6,189,625 B1 * 2/2001 Hopkins ..... A62C 99/0072 222/402.15
6,422,320 B1 * 7/2002 Mather ..... A62C 5/008 169/30
7,793,735 B2 * 9/2010 Hagar ..... A62C 13/68 239/599
8,662,192 B2 * 3/2014 Dunster ..... A62C 5/00 239/311
8,746,357 B2 * 6/2014 Butz ..... A62C 35/023 169/45
10,493,305 B2 * 12/2019 Senecal ..... A62C 13/68
2002/0027143 A1 * 3/2002 Schoenrock ..... A62C 31/02 222/200
2002/0148621 A1 * 10/2002 Yen ..... A62C 13/64 169/46
2004/0216903 A1 * 11/2004 Wierenga ..... A62C 35/58 169/85
2005/0001065 A1 * 1/2005 Senecal ..... B05B 1/341 239/461
2008/0128145 A1 * 6/2008 Butz ..... A62C 35/023 169/46
2009/0301601 A1 * 12/2009 Enerson ..... C06B 43/00 141/38
2010/0301129 A1 * 12/2010 Fenton ..... A62C 5/008 239/10
2011/0005780 A1 * 1/2011 Rennie ..... A62C 13/64 169/9
2011/0259617 A1 * 10/2011 Lelic ..... A62C 99/0072 169/37
2013/0098639 A1 * 4/2013 Dunster ..... A62C 13/66 169/9
2013/0213675 A1 * 8/2013 Rousseau ..... B05B 7/00 169/71
2014/0202719 A1 * 7/2014 Senecal ..... A62C 13/68 169/46
2015/0048176 A1 * 2/2015 Jones ..... B05B 7/0433 239/8
2016/0059058 A1 * 3/2016 Senecal ..... A62C 99/0072 169/47
2018/0250541 A1 * 9/2018 Flood ..... A62D 1/0021
2019/0374804 A1 * 12/2019 May ..... A62C 13/64
2021/0129095 A1 * 5/2021 Rogers ..... B01F 33/25
2021/0322809 A1 * 10/2021 Czarnek ..... A62C 5/008
2021/0331014 A1 * 10/2021 Swiderski ..... A62C 13/62

* cited by examiner

| | Water | Foam | Carbon Dioxide | Dry Chemical | Wet Chemical | Clean Agent | Dry Powder | Water Mist |
|---|---|---|---|---|---|---|---|---|
| Class A | ✓ | ✓ | ✗ | ✓ | Sometimes | Larger Models | ✗ | ✓ |
| Class B | ✗ | ✓ | ✓ | ✓ | ✗ | ✓ | ✗ | ✗ |
| Class C | ✗ | ✗ | ✓ | ✓ | ✗ | ✓ | ✗ | ✓ |
| Class D | ✗ | ✗ | ✗ | ✗ | ✗ | ✗ | ✓ | ✗ |
| Class K | ✗ | ✗ | ✗ | ✗ | ✓ | ✗ | ✗ | ✗ |
| Methods Used to Extinguish Flame | Removes the heat element | Separates the oxygen from the other elements | Takes away the oxygen and heat with cold discharge | Interrupts the chemical reaction (B,C) Creates a barrier between oxygen and fuel(A) | Removes heat and creates a barrier between oxygen and fuel | Interrupts the chemical reaction | Removes heat and creates a barrier between oxygen and fuel | Removes the heat element |

FIG. 1

WATER-MIST FIRE EXTINGUISHING SYSTEM

CROSS-REFERENCE TO RELATED APPLICATIONS

This application is the United States national phase of International Application No. PCT/US2018/032626 filed May 15, 2018, and claims the benefit of U.S. Provisional Patent Application No. 62/506,704 filed May 16, 2017, the disclosures of which are hereby incorporated by reference in their entirety.

BACKGROUND OF THE INVENTION

Field of the Invention

The present invention relates generally to fire extinguishers and, more particularly, to a liquid/water-based fire extinguisher capable of being used on a variety of different classes of fires.

Description of Related Art

There are many fire extinguishers, ranging from small portable extinguishers to large fire truck based extinguishers and stationary extinguishers in buildings and vehicles. Herein "fire extinguisher" and "extinguisher" should be understood to mean any one of a portable, hand held or wheeled fire extinguisher, a truck based fire extinguisher, or a stationary fire extinguisher.

Fires are classified by the following categories:

A Ash producing combustibles (wood, paper, fabrics, plastics).

B Flammable liquids (gasoline, oils, paint, tar).

C Fires involving live electrical equipment.

D Combustible metals or combustible metal alloys.

K Fires in cooking appliances that involve combustible cooking media: vegetable or animal oils and fats.

X Burning gases (the classification symbol varies between countries; X was chosen for the purpose of this disclosure).

With reference to FIG. 1, practically, each category of fire requires a different type of fire extinguisher. As can be seen in FIG. 1, some categories share types of extinguishers. For example, dry chemical extinguishers can be made to meet the requirements of classes A, B, and C. However, more often than not, the more universal the extinguisher is, the more harmful the active ingredient it utilizes. Collateral damage caused by use of an extinguisher can sometimes be worse than the fire itself. A water extinguisher or a $CO_2$ extinguisher used on a burning car engine might cause cracking of the engine block due to thermal shock. Dry chemical extinguishers might cause corrosion of electrical components and other devices under the car hood. Many extinguishers are either ineffective or dangerous if used on people.

Traditionally, water has been considered as fire extinguishing media only on A type fires. Used with spray nozzles, water can be used also on C type fires. Research demonstrates that water, if properly atomized, is very effective on most fires. With a proper additive, such as the F500 brand Encapsulator Agent available from Hazard Control Technologies of Fayetteville, Ga., USA 30214, water mist can even be used on combustible metals and burning gases, extending the applicability of a water-based extinguisher to most, if not all, categories of fires. Since water mist comprises small droplets of water, it can be used on people without the risk of injury to the face and eyes that could be expected if a stream-type water extinguisher or a firehose was used.

In order to be effective, the water mist must satisfy a number of criteria.

The water droplet size must be large enough to penetrate the fire and provide a practical distance between the fire and the firefighter.

The water droplet also must be small enough to have a large surface-to-volume ratio and not penetrate the surface of a burning fluid. To this end, a droplet that is too large, when used on burning gasoline will penetrate its surface and be ineffective in extinguishing the fire. In the case of burning oil, a water droplet too large will penetrate the oil surface and rapidly boil, splattering the oil and effectively increasing the fire intensity.

The discharge rate must be sufficient to provide enough water to absorb the heat from the flame and cool the surface of the burning material below the ignition temperature.

The spray plume angle (or spray cone) of the discharged water must be large enough to cover the burning surface and protect the firefighter, but small enough to direct the working media towards the flame.

Finally, the plume distribution must allow coverage of the burning area. For example, a hollow-cone type nozzle would not be effective in extinguishing the fire even though it would provide good protection for the firefighter. Therefore, the spray cone must be filled with mist.

The extinguisher must satisfy all the above-stated criteria within a large pressure range in order to be usable in fixed-charge extinguisher systems. By the time the extinguisher tank is empty the pressure in the tank or vessel might drop from, for example, 1500 kPa to less than 500 kPa. The discharge rate might change, but the mist quality must be maintained.

Prior art water extinguisher technology includes numerous nozzle designs combined with two major extinguisher designs. However, these nozzle designs either satisfy some but not all criteria listed above, or their complexity makes them prohibitively expensive to be used in mass production or even small series production of firefighting equipment.

There are three existing technologies of producing water mist of an effective droplet size to allow effective extinguishing of fires. The first technology is single phase atomization (or hydraulic atomizing), where water or a water solution is delivered under high pressure of order of 5000 kPa to 10,000 kPa to an atomizing nozzle. The second technology is air atomization, where a stream of liquid coming from a nozzle collides with one or more streams of gas blowing the liquid stream into droplets. The third technology is two-phase atomization which depends on the injection of gas delivered under moderate pressure, for example, 1000 kPa to 1800 kPa, into the stream of liquid before it reaches the orifice of the nozzle.

Single-phase atomization, due to the high-pressure requirement, is practical only in stationary industrial applications. Air atomization, commonly used in paint spray guns, requires a large volume of pressurized gas and is used in relatively low flow rate applications. Two-phase atomization requires a mechanism that delivers compressed gas to the water on the way to the orifice of a nozzle. In stationary or large wheeled fire extinguishers this can be accomplished by using a two tank system with a metering valve and an injecting system, see e.g., U.S. Pat. No. 7,523,876. In smaller, portable extinguishers, propellant gas used to pressurize the tank or vessel is used to both propel the water through the nozzle and to mix with the water stream to generate small bubbles that improve atomization of the water in the nozzle. This approach requires additional metering components in the extinguisher and reduces the flow rate of the fluid. U.S. Pat. No. 5,996,699 discloses a fire extinguisher equipped with a raising tube provided with side openings and a throttle in the area below the side openings. This design, however, requires large side openings and a large amount of propellant gas to produce mist of effective quality.

With reference to FIG. 2, currently there are two means of pressurizing fire extinguishers 100 for the purpose of expelling or dispersing fire extinguishing media 109 out of the storage vessel 101. In the most typical stored pressure configuration, found in water extinguishers as well as dry chemical extinguishers 100, the propellant gas, most often air or nitrogen, is stored in the same pressure vessel 101 as the fire extinguishing media 109 in the space 108 above it. In some extinguishers a small gas cartridge containing high pressure gas or liquid carbon dioxide can be used. In an emergency, the firefighter uses a built-in plunger to break a diaphragm on the cartridge, which releases the gas and, thus, propels fire extinguishing media 109 out of the extinguisher. Water extinguishers of this design come with a warning that they can be used on class A fires only.

A typical portable stored pressure extinguisher 100 includes a storage vessel 101, a control valve 102 equipped with both a carrying handle 103 and an operating lever 104. Some, usually bigger, extinguishers have a hose 105 attached to valve 102 and a discharge nozzle 106 attached to the end of hose 105, or if hose 105 is not present, nozzle 106 is attached directly to valve 102. The fire extinguishing media 109 (liquid or dry chemical) is stored in vessel 101 together with propellant gas stored in the space 108. The fire extinguishing media 109 is delivered to valve 102 through a discharge tube 107, also known as a siphon tube. In some jurisdictions it is sometimes required that discharge tube 107 be equipped with a mesh 110 to protect the flow path of the fire extinguishing media 109, including valve 102 and discharge nozzle 106 from debris.

It would be desirable to provide a fire extinguisher that produces a water-mist effective in fighting fires of various categories using inexpensive technology at moderate pressure levels. It would also be desirable to allow for conversion of existing fire extinguishers to produce a water-mist effective in fighting fires of various categories at moderate pressure levels as long as its components are protected from corrosion in long term contact with water and water solutions.

SUMMARY OF THE INVENTION

Generally, provided, in one preferred and non-limiting embodiment or example, is a fire extinguisher and method of use thereof that includes the extinguisher charged to an operating pressure with (at least) two gasses, one of which is substantially soluble in the fire extinguishing media of the extinguisher and the other of which is substantially insoluble in the fire extinguishing media. The extinguisher can also or alternatively include a nozzle that can form a plume of fine mist of the fire extinguishing media discharged from the extinguisher.

Further preferred and non-limiting embodiments or examples are set forth in the following numbered clauses.

Clause 1: A fire extinguisher comprising: a storage vessel; a control valve coupled to the storage vessel; a liquid fire extinguishing media comprising water in the storage vessel; a first gas charging the storage vessel to a partial pressure less than an operating pressure of the fire extinguisher; a second gas charging the storage vessel including the fire extinguishing media and the first gas to the operating pressure, wherein the first gas is at least an order of magnitude more soluble in the fire extinguishing media than the second gas, wherein at the operating pressure at least a portion of the first gas is dissolved in the fire extinguishing media; and a discharge tube extending between an input of the control valve and a location submerged in the fire extinguishing media, wherein the control valve is operative to control a discharge of the fire extinguishing media from the interior of the storage vessel via the discharge tube though an output of the control valve.

Clause 2: The fire extinguisher of clause 1, wherein the first gas can be carbon dioxide.

Clause 3: The fire extinguisher of clause 1 or 2, wherein the second gas can be nitrogen.

Clause 4: The fire extinguisher of any one of clauses 1-3, wherein each gas can have a purity of at least 95%.

Clause 5: The fire extinguisher of any one of clauses 1-4 can further include one or more holes along the length of the discharge tube.

Clause 6: The fire extinguisher of any one of clauses 1-5 can further include a nozzle coupled to the output of the control valve. The nozzle can have a plurality of exit channel pairs. Each exit channel pair can include first and second channels having respective axes that cross proximate an exterior of the nozzle.

Clause 7: The fire extinguisher of any one of clauses 1-6, wherein the nozzle can include a Venturi section through which the fire extinguishing media flows from the control valve to the exit channel pairs.

Clause 8: The fire extinguisher of any one of clauses 1-7, wherein at least 50% of the second gas can reside in a space between an interior of the storage vessel and the fire extinguishing media in the storage vessel.

Clause 9: The fire extinguisher of any one of clauses 1-8, wherein the solubility of the first gas in the fire extinguishing media at one atmosphere (101.325 kPa) can be between 0.5 and 3.5 grams of the first gas/kilogram of the fire extinguishing media between 0° C. and 60° C. The solubility of the second gas in the fire extinguishing media at one atmosphere can be between 0.01 and 0.03 grams of the second gas/kilogram of the fire extinguishing media between 0° C. and 60° C.

Clause 10: A method comprising: (a) providing the fire extinguisher of claim 1 including one or more holes along the length of the discharge tube submerged in the fire extinguishing media; (b) following step (a), operating the control valve to cause the fire extinguishing media to discharge from the storage vessel; and (c) during discharge of the fire extinguishing media from the storage vessel at least a portion of the second gas enters a flow of the fire extinguishing media in the discharge tube via the one or more holes in the discharge tube in response to said one or more holes becoming exposed to the second gas in the storage vessel with a falling level of the fire extinguishing media in the storage vessel, wherein the portion of the second gas entering the flow of the fire extinguishing media in the discharge tube forms bubbles of the second gas in the flow of the fire extinguishing media.

Clause 11: The method of clause 10 can further include, in response to the discharge of the fire extinguishing media, whereupon the fire extinguisher media in the storage vessel experiences decreasing pressure, at least a portion of the first gas releasing from the fire extinguishing media thereby forming bubbles of the first gas in the flow of the fire extinguishing media.

Clause 12: The method of clause 10 or 11 can further include, in response to the decreasing pressure in the storage vessel during discharge of the fire extinguishing media, at least a portion of the first gas dissolved in the fire extinguishing media releasing from the fire extinguishing media into a space inside the storage vessel.

Clause 13: The method of any one of clauses 10-12, wherein the first gas can release from the fire extinguishing media into the space in the storage vessel reinforcing with the second gas in the space the pressure in the storage vessel during discharge of the fire extinguishing media from the storage vessel.

Clause 14: The method of any one of clauses 10-13 can further include, following the flow of the fire extinguishing media passing through the discharge tube, causing the flow of the fire extinguishing media to exit a nozzle which separates the flow of fire extinguishing media exiting the nozzle into a first portion and a second portion.

Clause 15: The method of any one of clauses 10-14, wherein the first and second portions of the fire extinguishing media exiting the nozzle can collide forming a mist.

BRIEF DESCRIPTION OF THE DRAWINGS

These and other features of the present invention will become more apparent from the following description in which reference is made to the appended drawings wherein:

FIG. 1 is a compatibility table between fire classes and types of fire extinguishers;

DESCRIPTION OF THE INVENTION

Figure 2:
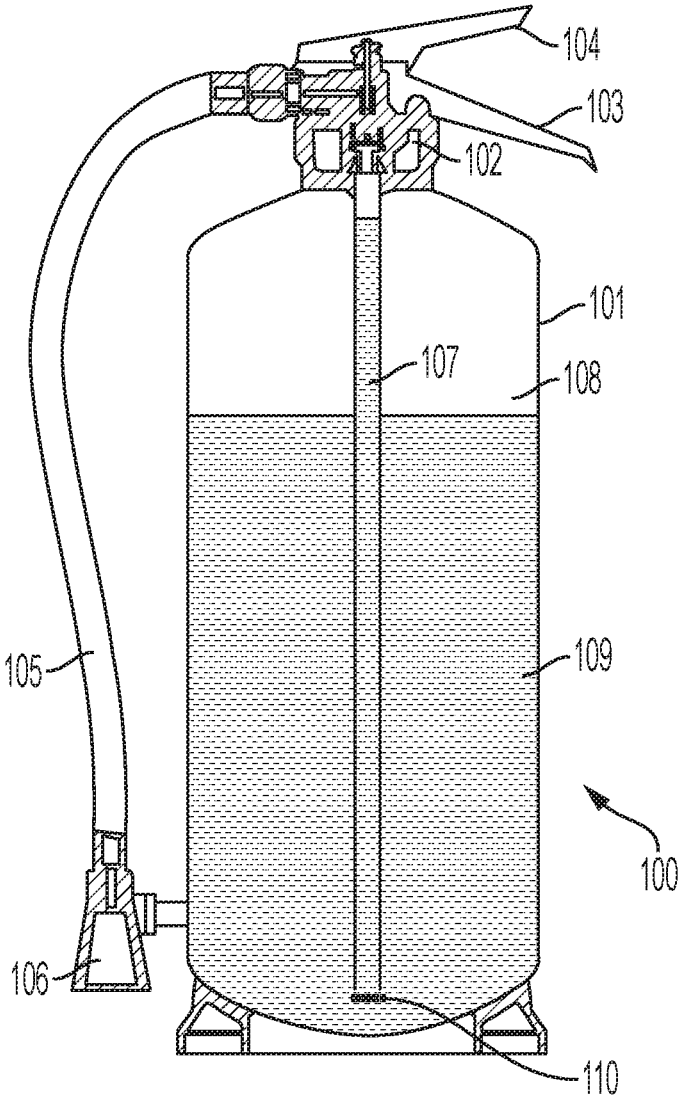
FIG. 2 is a schematic drawing of a prior art fluid charged fire extinguisher pressurized with propellant gas.

Various non-limiting examples will now be described with reference to the accompanying figures where like reference numbers correspond to like or functionally equivalent elements.

For purposes of the description hereinafter, the terms "end," "upper," "lower," "right," "left," "vertical," "horizontal," "top," "bottom," "lateral," "longitudinal," and derivatives thereof shall relate to the example(s) as oriented in the drawing figures. However, it is to be understood that the example(s) may assume various alternative variations and step sequences, except where expressly specified to the contrary. It is also to be understood that the specific example(s) illustrated in the attached drawings, and described in the following specification, are simply exemplary examples or aspects of the invention. Hence, the specific examples or aspects disclosed herein are not to be construed as limiting.

Referring to FIGS. 4-8, in one preferred and non-limiting embodiment or example, disclosed herein is an example extinguisher 100, which can be, for example, a portable extinguisher, a truck-based extinguisher, or a stationary fire extinguisher. Extinguisher 100 can include a nozzle 106 that is configured to finely atomize water-based solutions. Extinguisher 100 can also include means of creating a suspension of gas bubbles in a stream of fire extinguishing media 109 that can be output by extinguisher 100.

Figure 8:
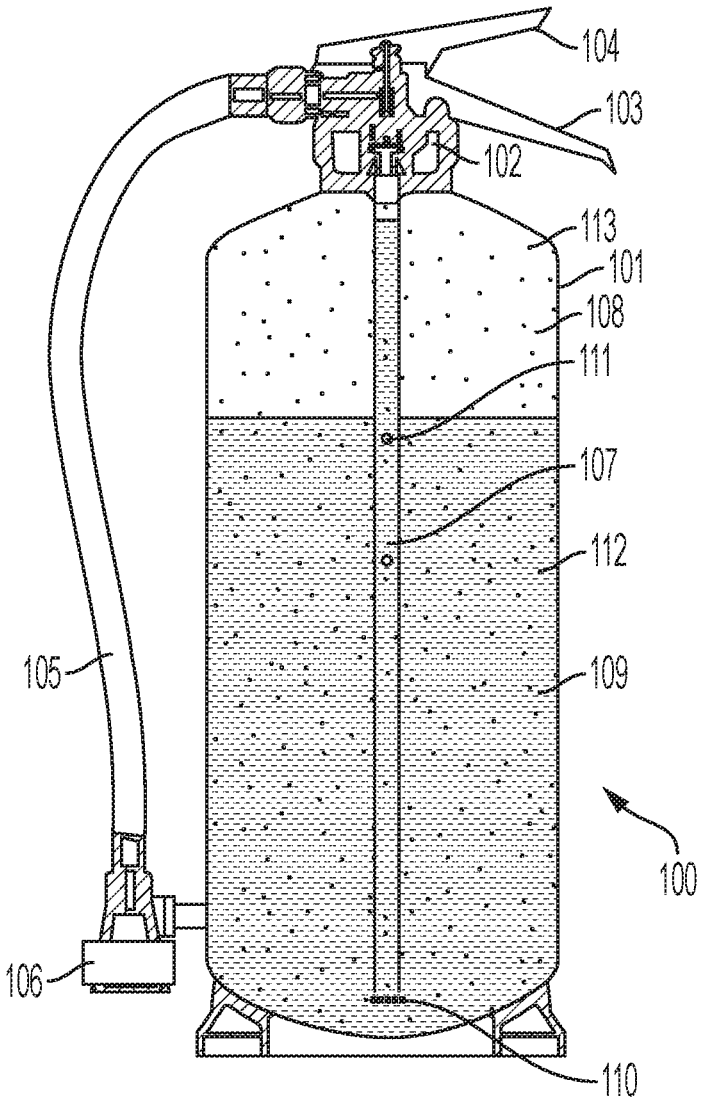
FIG. 8 is a schematic diagram of a fluid charged fire extinguisher in accordance with the principles of the present invention that is pressurized to an operating pressure with a first gas that is substantially dissolved in the fire extinguishing media and second, propellant gas in a space above the fire extinguishing media, wherein the fire extinguisher includes a discharge tube with one or more small holes along its length extending from a control valve into the fire extinguishing media and the nozzle of one of FIGS. 4-7.

The example extinguisher 100 shown in FIG. 8 is similar to the prior art extinguisher 100 shown in FIG. 2 with the exception that discharge tube 107 in the example extinguisher 100 shown in FIG. 8 can include one or more small holes 111 along its length. In an example, the diameter of each hole can be between 0.5 mm and 1.0 mm. The purpose of these holes 111 will be explained in greater detail hereinafter.

The solubility of carbon dioxide ($CO_2$) in water at room temperature (e.g., 20° C.) at one atmosphere (101.325 kPa) is approximately 100 times higher than the solubility of nitrogen ($N_2$) or air in water at the same temperature and pressure. Therefore, pressure variations due to temperature changes in extinguisher 100 charged only with $N_2$ will closely follow the isochoric relationship for ideal gas (Pressure/Temperature=Constant). For a typical operating temperature range for a $N_2$ charged, water-based extinguisher 100, namely, 5° C.-50° C., the resulting pressure variation from room temperature is about −5% to +10%, or a factor of 1.16 over the whole operating temperature range. As can be determined from the graph of FIG. 3, for the same extinguisher pressurized only with $CO_2$, over the same operating temperature range, the pressure would change by a factor of about 3. This means that an extinguisher charged with $CO_2$ at room temperature would reach dangerous pressure levels in a hot climate and would be ineffective due to low pressure in cold weather.

Figure 3:
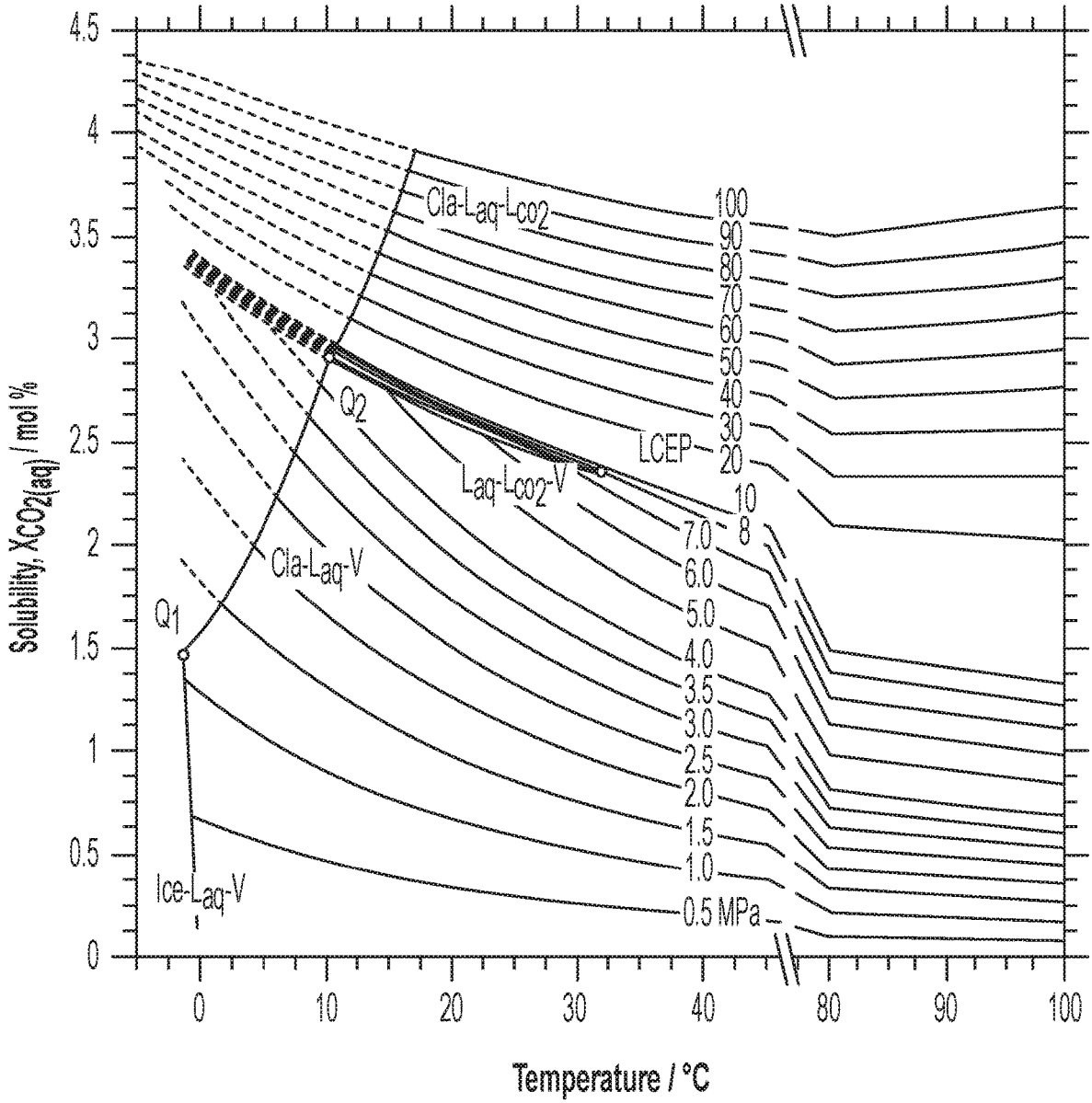
FIG. 3 is a diagram showing selected solubility isobars of $CO_2$ between 0.0° C. and 100° C. for carbon dioxide ($CO_2$) in water.
Figure 4:
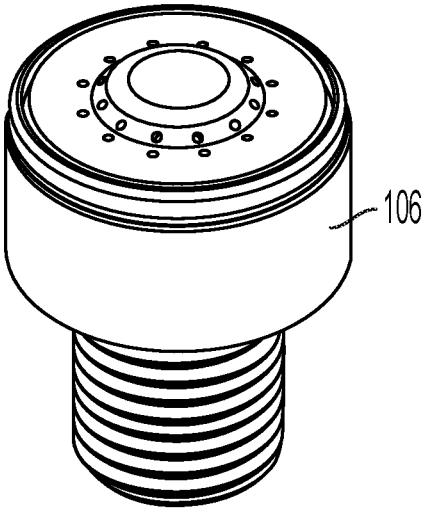
FIG. 4 is an assembled perspective view of a first example atomizing nozzle according to the principles of the present invention.
Figure 5:
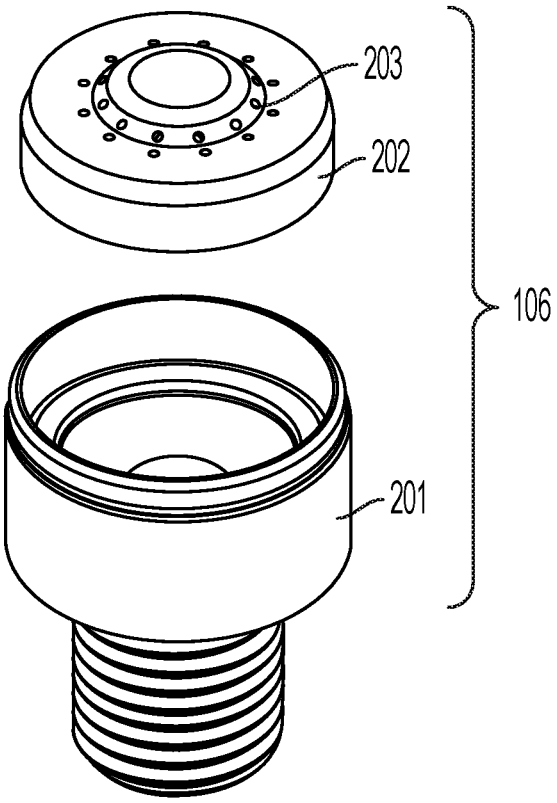
FIG. 5 is an exploded perspective view of the atomizing nozzle of FIG. 4.

The two most common standard pressures used for charging extinguishers, like extinguisher 100, are 690 kPa and 1500 kPa. For a 1500 kPa extinguisher 100, the rated (maximum) service pressure of storage vessel 101 is 2000 kPa. FIG. 3 shows that if storage vessel 101 of extinguisher 100 filled with water is pressurized at room temperature with $CO_2$ (a first gas) to a pressure of 1000 kPa, the molar concentration of $CO_2$ in the water will be 0.65% (about 16 grams per liter). If the temperature increases to 50° C., which is a typical upper limit for the temperature range of a water-based extinguisher, then the pressure inside storage vessel 101 will increase to about 1.8 kPa, which is within the rated pressure of a 1500 kPa extinguisher 100.

The solubility of $N_2$ (a second gas) in water is approximately 0.018 grams per liter of water at one atmosphere of pressure and room temperature. This means that if storage vessel 101 of extinguisher 100 filled with 1 liter of water is pressurized with 1 liter of $N_2$ at 1500 kPa, only about 1.5% of the $N_2$ would dissolve in the water. Therefore, storage vessel 101 filled with water and pressurized with $N_2$ will closely follow the isochoric relationship for ideal gas and will experience only small variations of pressure within storage vessel 101 between 5° C.-50° C.

In one preferred and non-limiting embodiment or example, storage vessel 101 of extinguisher 100 pressurized to a total (operating) pressure of, for example, 1500 kPa can be charged with $CO_2$ to a partial pressure of 1000 kPa and then to the operating pressure of 1500 kPa with $N_2$. An extinguisher so charged will maintain proper pressurization within its operating temperature range, namely, 5° C.-50° C. Since the solubility of $CO_2$ and $N_2$ as a function of pressure under 2000 kPa is nearly linear, the same analysis applies to a 690 kPa extinguisher. In the latter case, assuming the same safety factors, the 690 kPa extinguisher 100 can be charged with $CO_2$ to 460 kPa and then to its operating pressure with $N_2$. The effectiveness of a 690 kPa extinguisher 100 pressurized with $CO_2$ and $N_2$ in terms of its ability to generate fine mist will be lower than an extinguisher pressurized with $CO_2$ and $N_2$ to 1500 kPa, but can, for reasons discussed hereinafter, still be better than a similar extinguisher charged with $N_2$ alone. Higher pressures, e.g., greater than 1500 kPa, in storage vessel 101 are envisioned to improve mist quality. However, the required increase in storage vessel 101 strength, and therefore, weight and costs, may not make it practical or cost effective for many applications.

In one preferred and non-limiting embodiment or example, extinguisher 100 shown in FIG. 8 can be charged, for example, at room temperature to a partial pressure with a first gas 112, such as, for example, $CO_2$, and then to operating pressure, e.g., 69 kPa or 1500 kPa, with a propellant (or second) gas 113 such as, for example, air or $N_2$. The first gas 112 pressure can be selected so that the pressure inside storage vessel 101 does not exceed the rated pressure limit at the high end of the operating temperature range of (e.g., 5° C.-50° C.) of extinguisher 100. Then, the propellant gas 113 can be included inside storage vessel 101 to set the total pressure inside storage vessel 101 to the desired operating pressure, e.g., 690 kPa or 1500 kPa. Herein, the first gas 112 may be described as being $CO_2$ and the propellant (or second) gas 113 may be described as being air or $N_2$. However, this is not to be construed in a limiting sense since the use of any suitable and/or desirable first gas and/or second gas is envisioned.

In one preferred and non-limiting embodiment or example, during discharge of fire extinguishing media 109 from vessel 101, propellant (or second) gas 113 stays substantially in space 108 (except for propellant gas 113 dissolved in fire extinguishing media 109) pushing fire extinguishing media 109 containing dissolved first gas 112 out of storage vessel 101 via discharge tube 107. As the pressure within vessel 101 decreases during discharge of fire extinguishing media 109, at least a portion of the first gas 112 dissolved in fire extinguishing media 109 forms bubbles in fire extinguishing media 109 thereby improving the atomization efficiency of nozzle 106. In an example, $CO_2$ was chosen as first gas 112 due to its low toxicity, low cost, non-flammability, and high solubility in water. In principle, another gas with similar properties to $CO_2$ can also or alternatively be used as first gas 112 in extinguisher 100.

With specific reference to FIGS. 4-7, in one preferred and non-limiting embodiment or example, nozzle 106 can be a collision-type nozzle that can provide a desired flow rate and efficient atomization. Exit channel pairs 203 of nozzle 106 can each include a pair of channels 205 and 208. Each channel 205 can, in an example, have an axis 204 parallel or substantially parallel to an axis 209 of a body 201 of nozzle 106 and each channel 208 can, in an example, have an axis 207 transverse to axis 209 and which can intersect axis 204 at a predetermined angle 212 at a point 213 outside of body 201. The exit holes for each pair of channels 205, 208 can be separated by a predetermined distance 214. Angle 212 and distance 214 can be selected by one skilled in the art for a desired level of atomization, direction of a plume of fire extinguishing media 109 exiting nozzle 106, and angular dimension of the plume.

In one preferred and non-limiting embodiment or example, to facilitate shaping of the plume of fire extinguishing media 109 exiting nozzle 106, channels 205 and 208 of each exit channel pair 203 can have the same or different diameters and/or channel lengths. Also or alternatively, each channel 205 can have the same or different diameter and/or channel length as each other channel 205, and each channel 208 can have the same or different diameter and/or channel length as each other channel 208.

Figure 6:
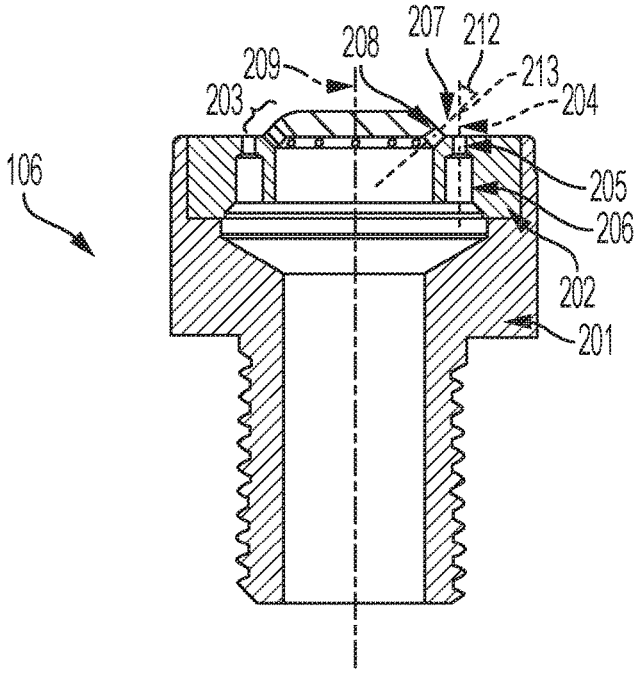
FIG. 6 is a cross-section of the atomizing nozzle of FIG. 4.
Figure 7:
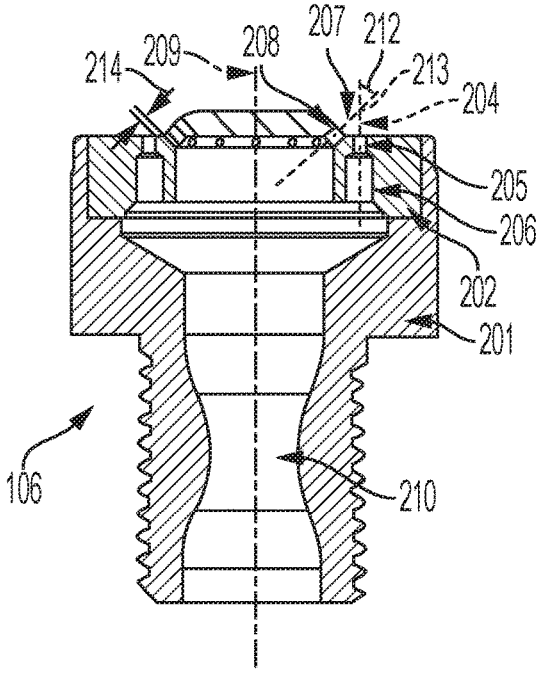
FIG. 7 is a cross-section of a second example atomizing nozzle, similar in most respects to the atomizing nozzle of FIG. 4, but further including a Venturi section.

In one preferred and non-limiting embodiment or example, the diameter of each channel 205 and/or 208 in nozzle faceplate 202 can be varied as needed, e.g., to allow the use of a small diameter-to-length ratio of each channel 205, 208. In an example, the diameter of each channel 205 and 208 can be between 0.5 mm and 1.0 mm Such configuration allows the construction of nozzle 106 capable of high pressure applications. Since nozzle 106 must be able to withstand the pressure of fire extinguishing media 109, and since the lengths of channels 205 and 208 affect the shape and/or formation of the plume or mist, one or both channels 205 and 208 of each exit channel pair 203 can have a variable cross-section. For example, as shown in FIGS. 6 and 7, each channel 205 having an axis 204 parallel to axis 209 can include a larger diameter portion 206 that supplies fire extinguishing media 109 to a smaller diameter portion. In an example, the larger diameter portion 206 can be twice the diameter of the smaller diameter portion of channel 205. In an example, the same concept can be used in the design of each channel 208 of each exit channel pair 203 of nozzle 106, namely, each channel 208 can include a larger diameter portion that supplies fire extinguishing media 109 to a smaller diameter portion.

In one preferred and non-limiting embodiment or example, FIG. 7 illustrates an example of nozzle 106 comprised of body 201 including an optional Venturi section 210. The pressure drop in the narrow part of Venturi section 210 can improve the formation of bubbles in the flow of fire extinguishing media 109 being discharged via the exit channel pairs 203 if soluble gas, such as first gas 112, e.g., $CO_2$, is dissolved in fire extinguishing media 109.

In one preferred and non-limiting embodiment or example, the formation of bubbles in the flow of fire extinguishing media 109 being discharged can be further improved by providing initiation bubbles into said flow. The provision of initiating bubbles can occur anywhere along the path between the inlet of discharge tube 107 and the output of nozzle 106. In one example, bubbles can be provided via one or more holes 111 along the length of discharge tube 107. In this example, as the level of fire extinguishing media 109 in storage vessel 101 drops below the height of each hole 111 during discharge of fire extinguishing media 109, second (propellant) gas 113 in space 108 can enter the flow of fire extinguishing media 109 in discharge tube 107 via said hole 111. In another example, a small pressure drop caused by, among other things, turbulence at the inlet of discharge tube 107 can cause small amounts of first gas 112 to initiate bubble of the first gas 112 in the flow of fire extinguishing media 109 in discharge tube 107.

In one preferred and non-limiting embodiment or example, the introduction of second (propellant) gas 113 into the flow of fire extinguishing media 109 can aid in formation of seed bubbles that improves the escape of the first gas 112 (e.g. $CO_2$) as the pressure drops along the path of the flow of fire extinguishing media 109 towards channels 205 and 208 of the nozzle 106. Dissolved first gas 112 escaping from fire extinguishing media 109 into storage vessel 101 can also aid in supporting the pressure in storage vessel 101 during discharge of fire extinguishing media 109. Introduction of first gas 112 (e.g. $CO_2$) into the fire extinguishing media 109 can therefore aid in decreasing the pressure drop in storage vessel 101, improving the intensity and uniformity of the discharge rate of the extinguishing media 109.

In one preferred and non-limiting embodiment or example, the amount of second (propellant) gas 113 entering the stream of fire extinguishing media 109 being discharged is, in an example, relatively small, whereupon the resulting drop in the pressure of the second (propellant) gas 113 in space 108 and the amount of propellant gas 113 entering the stream of fire extinguishing media 109 are not expected to adversely affect the use of extinguisher 100.

In one preferred and non-limiting embodiment or example, each of the dissolved first gas 112 (e.g. $CO_2$) and nozzle 106 can be used alone or in combination to improve the performance of an existing water based extinguisher 100. However, in an example, their combined effects can be synergistic resulting in an improvement in performance to the point that the resulting mist or plume produced by extinguisher 100 can be used in fighting fires of most, if not all, categories.

As can be seen, disclosed herein is a fire extinguisher 100 comprising: a storage vessel 101, a control valve 102 coupled to the storage vessel 101, a liquid fire extinguishing media 109 comprising water in the storage vessel 101, a first gas 112 charging the storage vessel 101 to a partial pressure less than an operating pressure of the fire extinguisher 100, a second gas 113 charging the storage vessel 101 including the fire extinguishing media 109 and the first gas 112 to the operating pressure, wherein the first gas 112 is at least one order of magnitude more soluble in the fire extinguishing media 109 than the second gas 113, wherein at the operating pressure at least a portion of the first gas 112 is dissolved in the fire extinguishing media 109; and a discharge tube 107 extending between an input of the control valve 102 and a location submerged in the fire extinguishing media 109, wherein the control valve 102 is operative to control a discharge of the fire extinguishing media 109 from the interior of the storage vessel 101 via the discharge tube 107 though an output of the control valve 102.

The first gas 112 can be carbon dioxide. The second gas 113 can be nitrogen. Each gas can have a purity of at least 95%.

One or more holes 111 can be provided along the length of the discharge tube 107.

A nozzle 106 can be coupled to the output of the control valve 102. The nozzle 106 can have a plurality of exit channel pairs 203. Each exit channel pair 203 can include first and second channels 205, 208 having respective axes 204, 207 that cross 213 proximate an exterior of the nozzle 106.

The nozzle 106 can include a Venturi section 210 through which the fire extinguishing media 109 flows from the control valve 102 to the exit channel pairs 203.

At least 50% of the second gas 113 can reside in a space 108 between an interior of the storage vessel 101 and the fire extinguishing media 109 in the storage vessel 101.

The solubility of the first gas 112 in the fire extinguishing media 109 at one atmosphere (101.325 kPa) can be between 0.5 and 3.5 grams of the first gas/kilogram of the fire extinguishing media 109 between 0° C. and 60° C. The solubility of the second gas 113 in the fire extinguishing media 109 at one atmosphere can be between 0.01 and 0.03 grams of the second gas/kilogram of the fire extinguishing media 109 between 0° C. and 60° C.

Also disclosed herein is a method comprising: (a) providing the fire extinguisher 100 described herein including one or more holes 111 along the length of the discharge tube 107, said one or more holes 111 submerged in the fire extinguishing media 109; (b) following step (a), operating the control valve 102 to cause the fire extinguishing media 109 to discharge from the storage vessel 101; and (c) during discharge of the fire extinguishing media 109 from the storage vessel 101 at least a portion of the second gas 113 entering a flow of the fire extinguishing media 109 in the discharge tube 107 via the one or more holes 111 in the discharge tube 107 in response to said one or more holes 111 becoming exposed to the second gas 113 in the storage vessel 101 with a falling level of the fire extinguishing media 109 in the storage vessel 101, wherein the portion of the second gas 113 entering the flow of the fire extinguishing media 109 in the discharge tube 107 forms bubbles of the second gas 113 in the flow of the fire extinguishing media 109.

In response to the fire extinguishing media 109 flowing in the discharge tube 107 experiencing decreasing pressure, at least a portion of the first gas 112 can be released from the fire extinguishing media 109 flowing in the discharge tube 107 thereby forming bubbles of the first gas 112 in the flow of the fire extinguishing media 109 in the discharge tube 107.

In response to a decreasing pressure in the storage vessel 101 during discharge of the fire extinguishing media 109 from the storage vessel 101, at least a portion of the first gas 112 dissolved in the fire extinguishing media 109 can be released from the fire extinguishing media 109 into a space 108 inside the storage vessel 101.

The first gas 112 released from the fire extinguishing media 109 into the space 108 in the storage vessel 101 can reinforce with the second gas 113 in the space 108 the pressure in the storage vessel 101 during discharge of the fire extinguishing media 109 from the storage vessel 101.

Following the flow of the fire extinguishing media 109 through the discharge tube 107, causing the flow of the fire extinguishing media 109 to exit a nozzle 106 which separates the flow of fire extinguishing media 109 exiting the nozzle 106 into a first portion (that flows along axis 204) and a second portion (that flows along axis 207).

The first and second portions of the fire extinguishing media 109 exiting the nozzle 106 collide (at point 213) forming a mist of the fire extinguishing media 109.

Although the invention has been described in detail for the purpose of illustration based on what is currently considered to be the most practical preferred and non-limiting embodiments, examples, or aspects, it is to be understood that such detail is solely for that purpose and that the invention is not limited to the disclosed preferred and non-limiting embodiments, examples, or aspects, but, on the contrary, is intended to cover modifications and equivalent arrangements that are within the spirit and scope of the appended claims. For example, it is to be understood that the present invention contemplates that, to the extent possible, one or more features of any preferred and non-limiting embodiment, example, or aspect can be combined with one or more features of any other preferred and non-limiting embodiment, example, or aspect.

The invention claimed is:

1. A fire extinguisher comprising:

a storage vessel;

a control valve coupled to the storage vessel;

a liquid fire extinguishing media comprising water in a first part of the storage vessel;

a first gas charging the storage vessel to a partial pressure less than an operating pressure of the fire extinguisher;

a second gas in a second part of the storage vessel charging the storage vessel including the fire extinguishing media and the first gas to the operating pressure, wherein the first gas is at least one order of magnitude more soluble in the fire extinguishing media than the second gas, wherein at the operating pressure at least a portion of the first gas is dissolved in the fire extinguishing media and a least a portion of the second gas is in direct contact with the fire extinguishing media; and a discharge tube extending between an input of the control valve and a location submerged in the fire extinguishing media, wherein the control valve is operative to control a discharge of the fire extinguishing media from the interior of the storage vessel via the discharge tube through an output of the control valve, wherein bubbles form in the fire extinguishing media as the fire extinguishing media flows from the storage vessel through the output of the control valve.

2. The fire extinguisher of claim 1, wherein the first gas is carbon dioxide.

3. The fire extinguisher of claim 1, wherein the second gas is nitrogen.

4. The fire extinguisher of claim 1, wherein each gas has a purity of at least 95%.

5. The fire extinguisher of claim 1, further including one or more holes along the length of the discharge tube.

6. The fire extinguisher of claim 1, further including a nozzle coupled to the output of the control valve, said nozzle having a plurality of exit channel pairs, each exit channel pair including first and second channels having respective central axes that cross proximate an exterior of the nozzle.

7. The fire extinguisher of claim 1, wherein the nozzle includes a Venturi section through which the fire extinguishing media flows from the control valve to the exit channel pairs.

8. The fire extinguisher of claim 1, wherein at least 50% of the second gas resides in a space between an interior of the storage vessel and the fire extinguishing media in the storage vessel.

9. The fire extinguisher of claim 1, wherein:

a solubility of the first gas in the fire extinguishing media at one atmosphere (101.325 kPa) is between 0.5 and 3.5 grams of the first gas/kilogram of the fire extinguishing media between 0° C. and 60° C.; and a solubility of the second gas in the fire extinguishing media at one atmosphere is between 0.01 and 0.03 grams of the second gas/kilogram of the fire extinguishing media between 0° C. and 60° C.

10. A method comprising:

(a) providing the fire extinguisher of claim 1 including one or more holes along the length of the discharge tube submerged in the fire extinguishing media;

(b) following step (a), operating the control valve to cause the fire extinguishing media to discharge from the storage vessel; and (c) during discharge of the fire extinguishing media from the storage vessel at least a portion of the second gas enters a flow of the fire extinguishing media in the discharge tube via the one or more holes in the discharge tube in response to said one or more holes becoming exposed to the second gas in the storage vessel with a falling level of the fire extinguishing media in the storage vessel, wherein the portion of the second gas entering the flow of the fire extinguishing media in the discharge tube forms the bubbles in the flow of the fire extinguishing media.

11. The method of claim 10, further including:

in response to the discharge of the fire extinguishing media whereupon the fire extinguishing media in the storage vessel experiences decreasing pressure, at least a portion of the first gas releases from the fire extinguishing media thereby forming the bubbles in the flow of the fire extinguishing media.

12. The method of claim 10, further including:

in response to a decreasing pressure in the storage vessel during discharge of the fire extinguishing media, at least a portion of the first gas dissolved in the fire extinguishing media releases from the fire extinguishing media into a space inside the storage vessel.

13. The method of claim 12, wherein the first gas released from the fire extinguishing media into the space in the storage vessel reinforces with the second gas in the space the pressure in the storage vessel during discharge of the fire extinguishing media from the storage vessel.

14. The method of claim 10, further including:

following the flow of the fire extinguishing media passing through the discharge tube, causing the flow of the fire extinguishing media to exit a nozzle which separates the flow of fire extinguishing media exiting the nozzle into a first portion and a second portion.

15. The method of claim 10, wherein at the first and second portions of the fire extinguishing media exiting the nozzle collide forming a mist.

16. The fire extinguisher of claim 1, wherein the first gas dissolved in the fire extinguishing media forms a suspension of the bubbles in the fire extinguishing media as the fire extinguishing media flows from the storage vessel through the output of the control valve.

17. The fire extinguisher of claim 1, wherein the first gas dissolved in the fire extinguishing media forms a suspension of the bubbles in the fire extinguishing media in response to a pressure of the fire extinguishing media decreasing in response to the fire extinguishing media flowing from the storage vessel through the output of the control valve.

18. The fire extinguisher of claim 1, wherein the bubbles form:

along the length of the discharge tube; or at the location of the discharge tube submerged in the fire extinguishing media.

19. The fire extinguisher of claim 1, wherein the bubbles form along the path of the flow of the fire extinguishing media between the bottom end of the discharge tube and a discharge nozzle.

* * * * *